US007731149B2

(12) United States Patent
Del Zotto

(10) Patent No.: US 7,731,149 B2
(45) Date of Patent: Jun. 8, 2010

(54) SEPTIC TANK FORM

(75) Inventor: William M. Del Zotto, Duluth, MN (US)

(73) Assignee: Del Zotto Products, Inc., Wrenshall, MN (US)

( * ) Notice: Subject to any disclaimer, the term of this patent is extended or adjusted under 35 U.S.C. 154(b) by 1036 days.

(21) Appl. No.: 11/209,207

(22) Filed: Aug. 22, 2005

(65) Prior Publication Data

US 2006/0065994 A1 Mar. 30, 2006

Related U.S. Application Data

(60) Provisional application No. 60/603,507, filed on Aug. 20, 2004.

(51) Int. Cl.
*B28B 7/24* (2006.01)

(52) U.S. Cl. ..... 249/126; 249/105; 249/119; 249/121; 249/122; 249/123; 249/130; 249/131; 249/144; 249/163

(58) Field of Classification Search ..... 264/126
See application file for complete search history.

(56) References Cited

U.S. PATENT DOCUMENTS 2,873,504 A * 2/1959 Lager ..... 425/432
3,011,241 A * 12/1961 Fry et al. ..... 425/258
3,166,817 A * 1/1965 Cordova ..... 249/63
3,233,294 A * 2/1966 Carpousis et al. ..... 164/121
3,350,051 A * 10/1967 Haase, Jr. et al. ..... 249/91
3,687,597 A * 8/1972 Lavergne, Jr. ..... 425/438
4,372,018 A * 2/1983 Miller et al. ..... 27/35
5,171,507 A 12/1992 Del Zotto
5,285,914 A 2/1994 Del Zotto
5,381,995 A 1/1995 Del Zotto
5,454,544 A 10/1995 Del Zotto
5,582,310 A 12/1996 Del Zotto
5,720,467 A 2/1998 Del Zotto
5,865,346 A 2/1999 Del Zotto
5,881,760 A 3/1999 Del Zotto
2002/0109068 A1 * 8/2002 Staskiewicz et al. ..... 249/105

FOREIGN PATENT DOCUMENTS

CA 2142627 8/1996

OTHER PUBLICATIONS

Del Zotto, Form Buyer Catalog—2003, 2000-2003, 32 pages.
Del Zotto, Septic Tank Forms Catalog, 2000-2002, 12 pages.

* cited by examiner

*Primary Examiner*—Philip C Tucker
*Assistant Examiner*—Amjad Abraham
(74) *Attorney, Agent, or Firm*—Patterson, Thuente, Christensen, Pedersen, P.A.

(57) ABSTRACT

A casting mold including a first form having a first wall and a second wall, the first and second walls defining a first casting space. The casting mold further including a second form having a base and a wall extending from the base to define a second casting space. The second form is stackable on the first form portion such that the first and second casting spaces can be filled with a casting material when the second form is on the first form. The second form includes a port defining access into the first casting space such that the casting material can be disposed into the first casting space through the port.

14 Claims, 12 Drawing Sheets

SEPTIC TANK FORM

RELATED APPLICATION

The present application claims the benefit of U.S. Provisional Application No. 60/603,507 filed Aug. 20, 2004, which is incorporated herein in its entirety by reference.

FIELD OF THE INVENTION

The present invention relates to the fabrication of concrete casting forms. More particularly, the present invention relates to a concrete septic tank form.

BACKGROUND OF THE INVENTION

Underground septic and holding tanks can be fabricated from concrete by pouring the concrete into a mold and curing the concrete. Concrete septic tanks generally can comprise two portions: a vault portion and a lid portion placed on the vault portion. To make the concrete septic tanks, each of the two portions generally require a separate mold form and are poured and cured separately.

Conventional septic tank casting processes generally require separate molds for the lid and vault portions, which can occupy a large amount of space. Specifically, because separate molds are generally required for the vault and lid castings, approximately twice the floor space of an assembled enclosure is required for forming and curing a complete septic tank assembly.

Also, once casting material has been filled in the vault and lid mold forms during conventional septic tank casting processes, each of the forms generally must be vibrated separately, thus leading to additional processing time.

Because the general problems discussed above have not been addressed by conventional septic and holding tanks, there is a current need for a septic tank form addressing the problems and deficiencies inherent with conventional designs.

SUMMARY OF THE INVENTION

The septic tank form and method of using thereof according to the various embodiments substantially solves the problems of conventional septic and holding tanks by providing stackable vault and lid forming portions and eliminating the need for a separate pouring pan. By doing so, the amount of floor space of an assembled enclosure required for forming and curing a complete septic tank assembly can be minimized.

A feature and advantage of the various embodiments of the present invention is that both the upper form and the lower form can be cast in one pour.

Another feature and advantage of the various embodiments of the present invention is that because the forms are stacked, the floor space occupied during a curing operation can be minimized.

A further feature and advantage of the various embodiments of the present invention is that a separate pouring pan can be eliminated.

Another feature and advantage of the various embodiments of the present invention is that the vault and lid forms can be vibrated in one step by a vibrated included on the form.

DETAILED DESCRIPTION OF THE DRAWINGS

Figure 1:
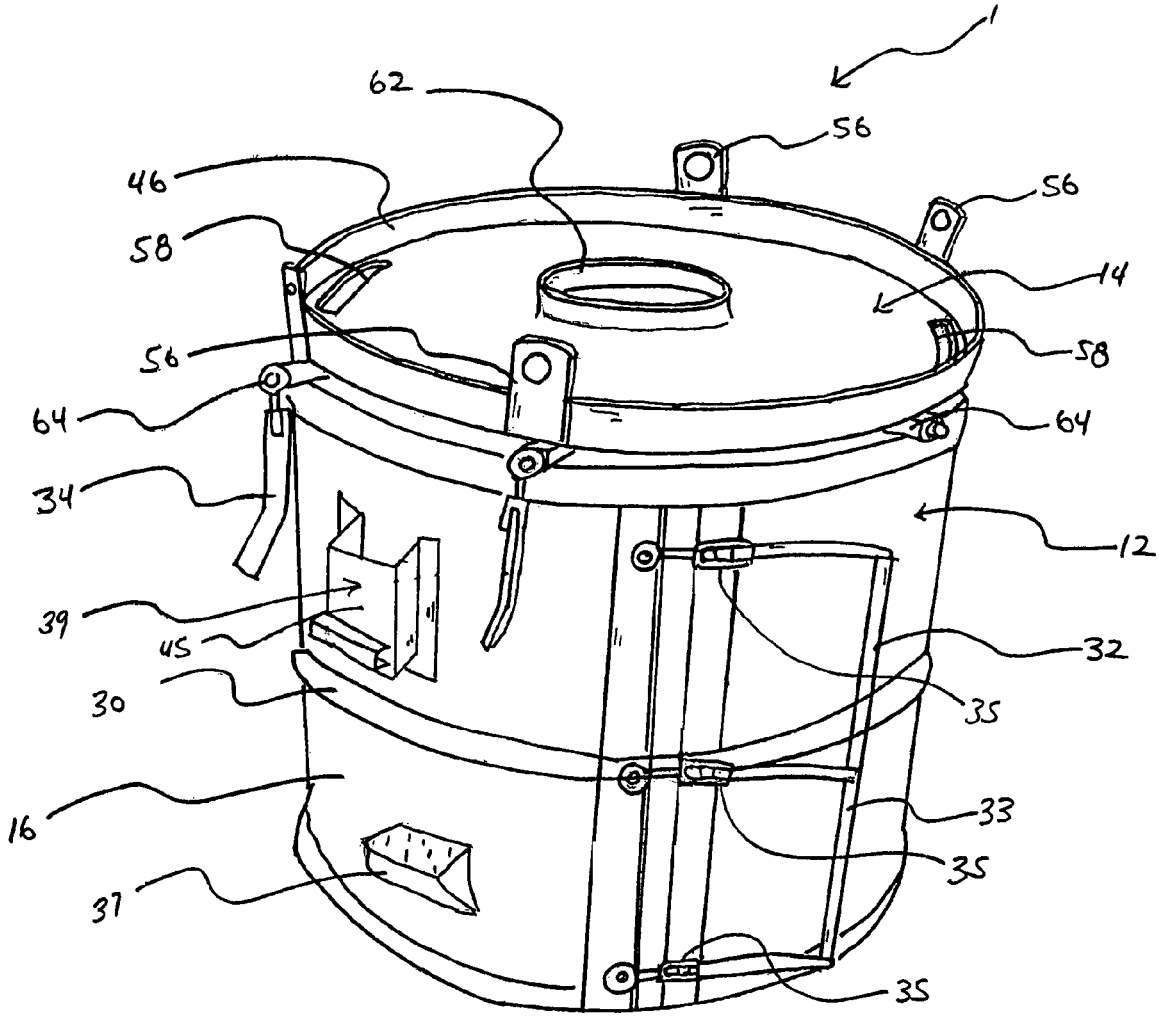
FIG. 1 is a perspective view of a septic tank casting form according to a first embodiment of the present invention.
Figure 2:
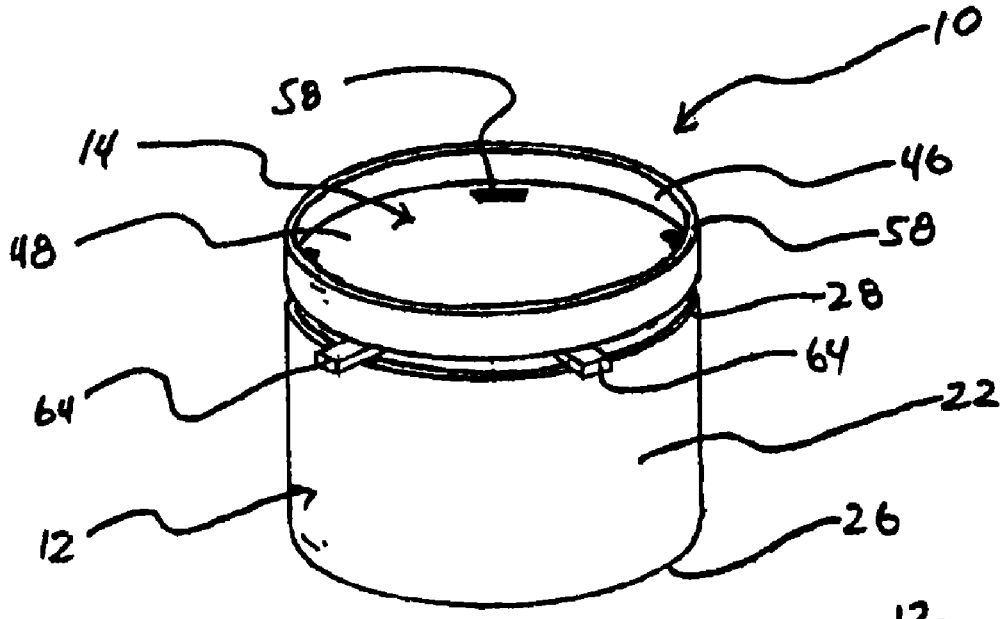
FIG. 2 is a perspective view of a septic tank casting form according to a first embodiment of the present invention.
Figure 13:
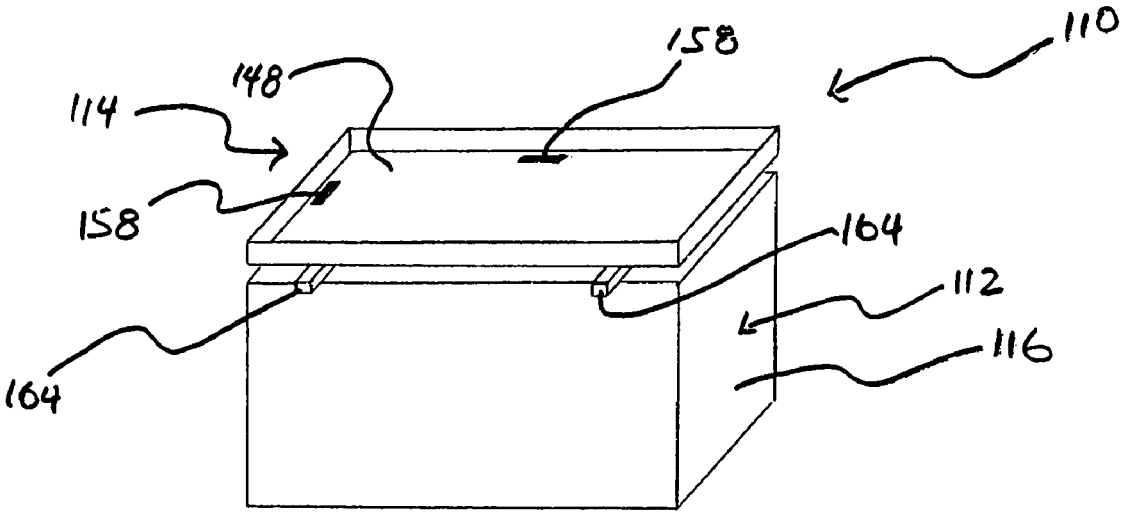
FIG. 13 is a perspective view of a septic tank casting form according to a second embodiment of the present invention.
Figure 14:
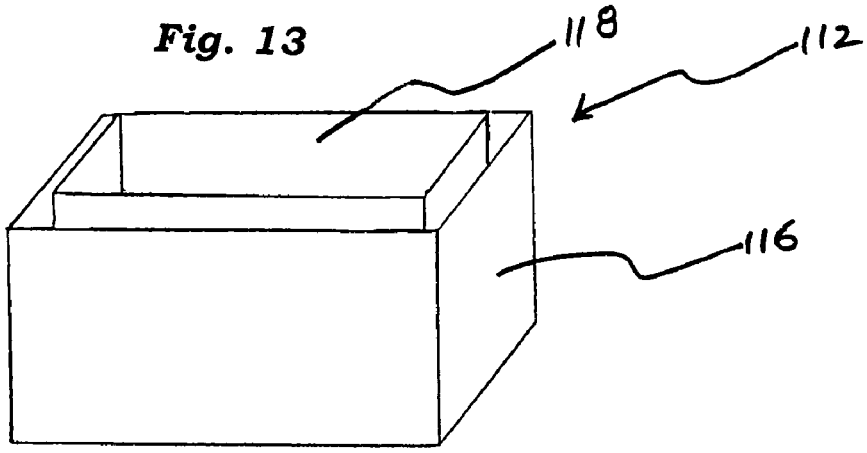
FIG. 14 is a perspective view of a vault form portion of a septic tank casting form according to a second embodiment of the present invention.
Figure 15:
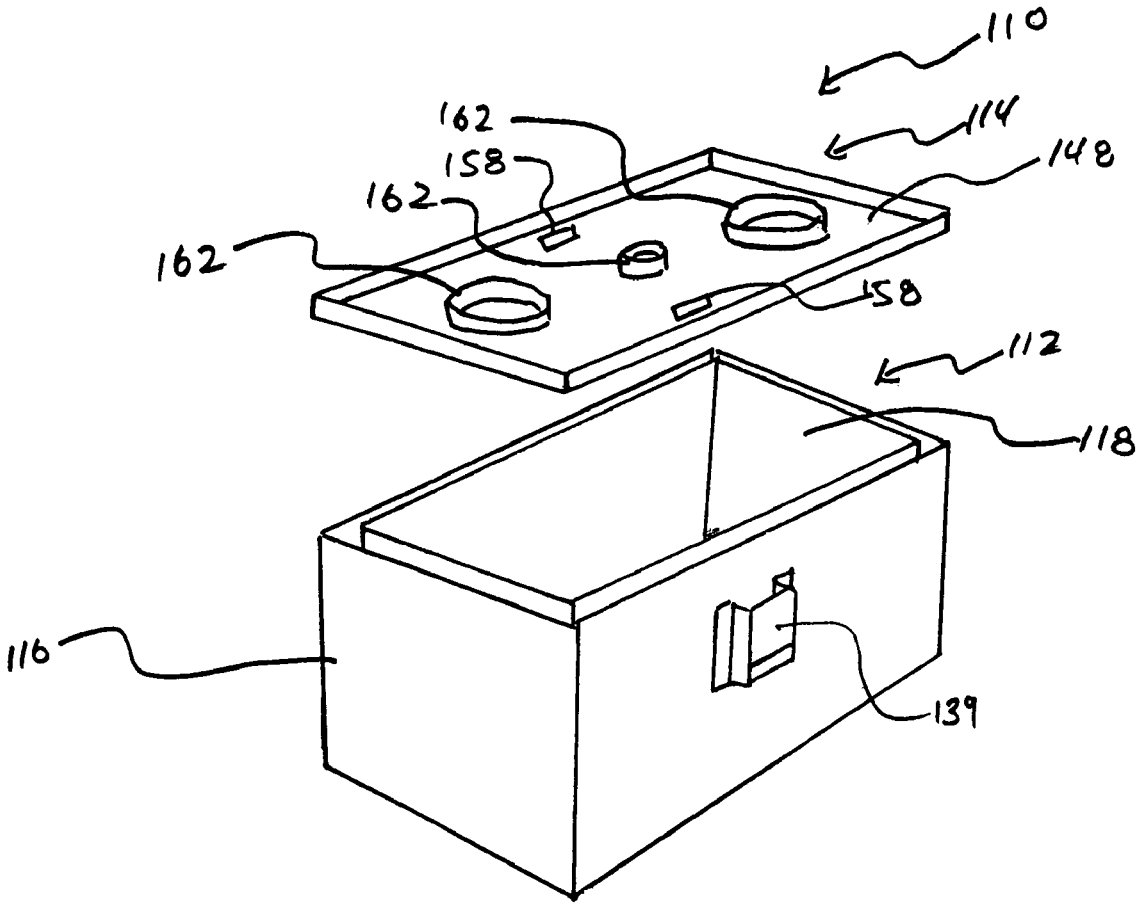
FIG. 15 is a perspective view of a septic tank casting form according to a second embodiment of the present invention.

Referring to FIGS. 1 and 2, a septic tank form 10 according to the various embodiments of the present invention generally comprises a bottom or vault form portion 12 and a top or lid form portion 14. The vault and lid form portions 12, 14 can be used to cast a septic tank lid and vault, respectively, with a casting material such as concrete. The lid form portion 14 can also function as a pouring pan for the vault form portion 12. As will be discussed in detail herein, the septic tank form 10 according the various embodiments can be generally cylindrical in shape, as depicted in FIGS. 1-12. Alternatively, the septic tank form 10 can comprise various regular or irregular multi-sided shapes, such as a rectangle, as depicted in FIGS. 13-15.

Figure 3:
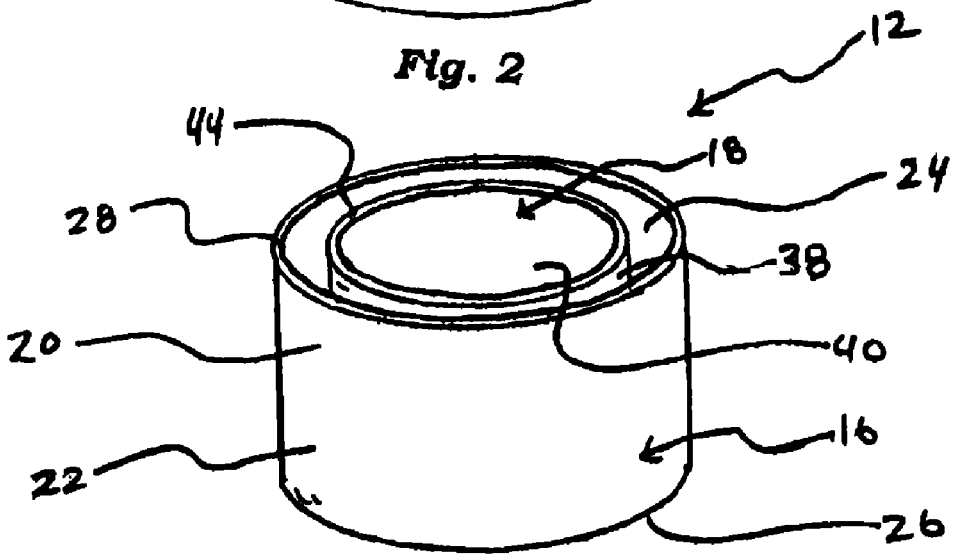
FIG. 3 is a perspective view of a vault form portion of a septic tank casting form according to a first embodiment of the present invention.
Figure 6:
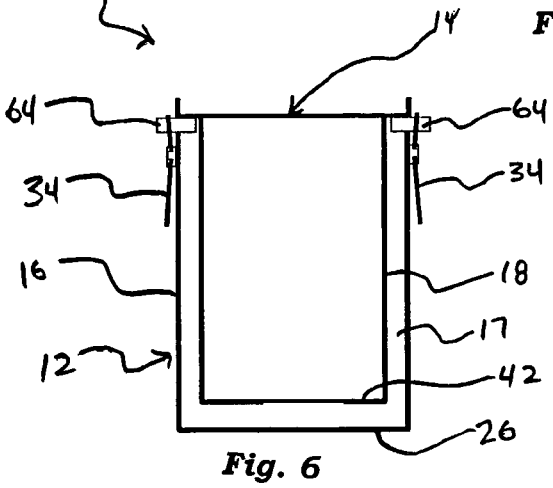
FIG. 6 is a cross-sectional view of a septic tank casting form according to a first embodiment of the present invention along line 6-6 of FIG. 4.
Figure 5:
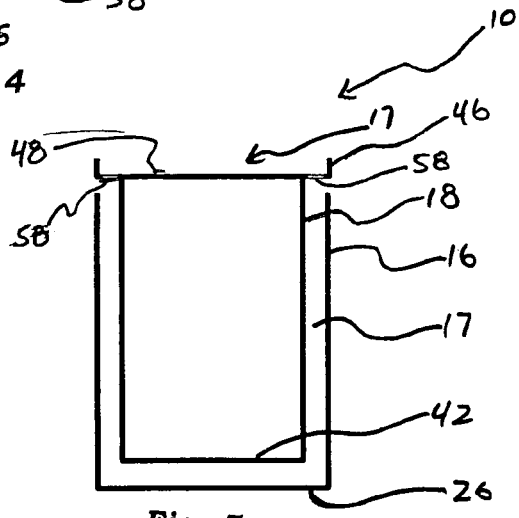
FIG. 5 is a cross-sectional view of a septic tank casting form according to a first embodiment of the present invention along line 5-5 of FIG. 4.

Referring to FIGS. 3 and 5-6, the vault form portion 12 generally comprises an outer shell 16 and a corresponding inner shell 18. When the vault form portion 12 is being used to form a vault casting, the inner shell 18 is generally placed into the outer shell 16 to define a vault casting space 17 between the shells. The size and shape of the vault casting space 17 will then substantially correspond to the size and shape of the vault casting.

The outer shell 16 generally comprises a wall 20 having an outer surface 22 and a generally opposed inner surface 24. The outer shell 16 also comprises a generally planar bottom or base 26 operably coupled to or integrally formed with the outer shell wall 20. The outer shell 14 also can comprise an upper edge or margin 28 that is generally opposed the outer shell base 26.

The outer shell 16 can comprise one or more strengthening bands 30 operably coupled to or integrally formed with the outer or inner surfaces 22, 24 of the outer shell wall 20. As depicted in FIG. 1, the strengthening band 30 is operably coupled to the outer surface 22 of the out shell 16 and can inhibit damage on the outer shell 16 of the vault form portion 12 when the concrete is poured into the vault form portion 12. The strengthening band 30 can also provide further structure and support for the binder clamp 32, described in greater detail below.

Figure 16:
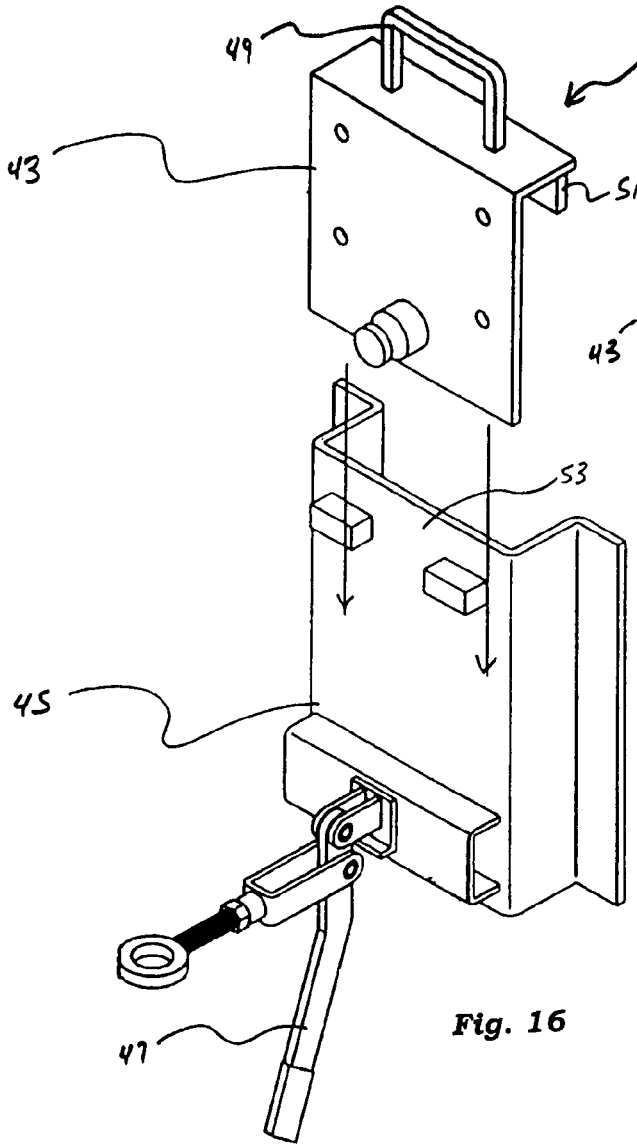
FIG. 16 is a perspective view of a vibrator bracket portion being operably coupled with a form bracket portion of a vibrator bracket according to the present invention.
Figure 17:
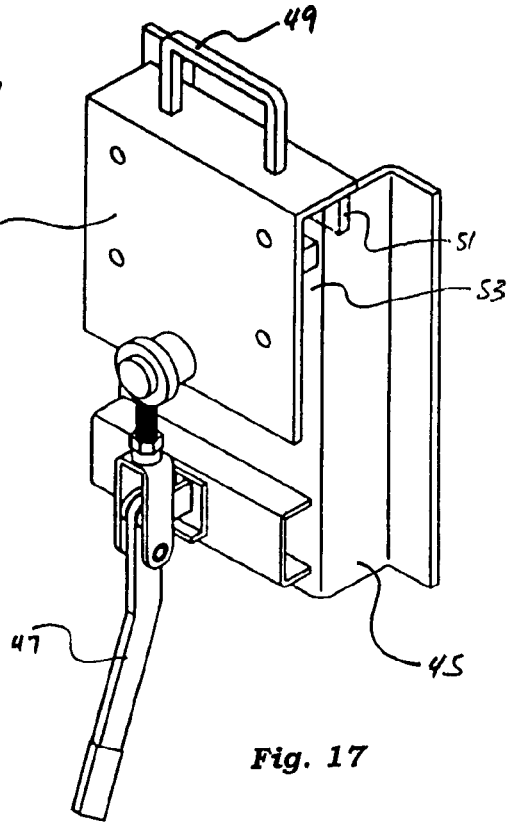
FIG. 17 is a perspective view of a vibrator bracket portion operably coupled with a form bracket portion of a vibrator bracket according to the present invention.

Referring to FIG. 1, the outer shell 16 also can comprise a binder clamp 32, which can enable ease of removal and stripping of the vault form portion 12 from the concrete vault casting once the casting has cured. The binder clamp 32 comprises a handle 33 and a plurality of latch mechanisms 35. The binder clamp 32 as depicted in FIG. 1 is an engaged position. To enable ease of removal of the vault form portion 12, the binder clamp 32 handle is displaced such that the binder clamp 32 is in a disengaged position. The binder clamp mechanisms can be over center latches such as illustrated in FIGS. 16 and 17 and discussed infra.

The outer shell 16 can also comprise a plurality of lid closure latches 34 operably coupled thereto and can be in operable communication with structure included on the lid form portion 14 to assure that the lid form portion 14 is operably secured to the vault form portion 12 during the concrete curing process. As depicted in FIG. 1, the lid closure latches 34 are operably coupled to spacers 64 that are operably attached to the lid form portion 14. The spacers 64 are described in greater detail below.

The lid closure latches 34 can restrain and inhibit or prevent any upward movement of the lid form 14 when casting material is disposed into the vault casting space 17. Such movement can result from the upward forces generated on the lid form 14 and inner shell, if attached to the lid form 14, as the casting material is disposed into the vault casting space 17. The inner shell 18 and the filling of the vault casting space 17 is described in greater detail herein.

The outer shell 16 can also comprise one or more steps 37 thereon to enable a user to look into the form 10 during the casting process. The steps 37 can be formed of sheet steel, such as textured plate steel, and can be welded or otherwise operably coupled to the outer shell. Those of skill in the art would recognize that the steps 37 can be constructed of various engineering materials. The outer shell 16 can also comprise a vibrator bracket 39 upon which a vibrator system 41 can be operable coupled. When coupled with the vibrator bracket 39, the vibrator system 41 can vibrate both the vault and lid form portions 12, 14.

Figure 18:
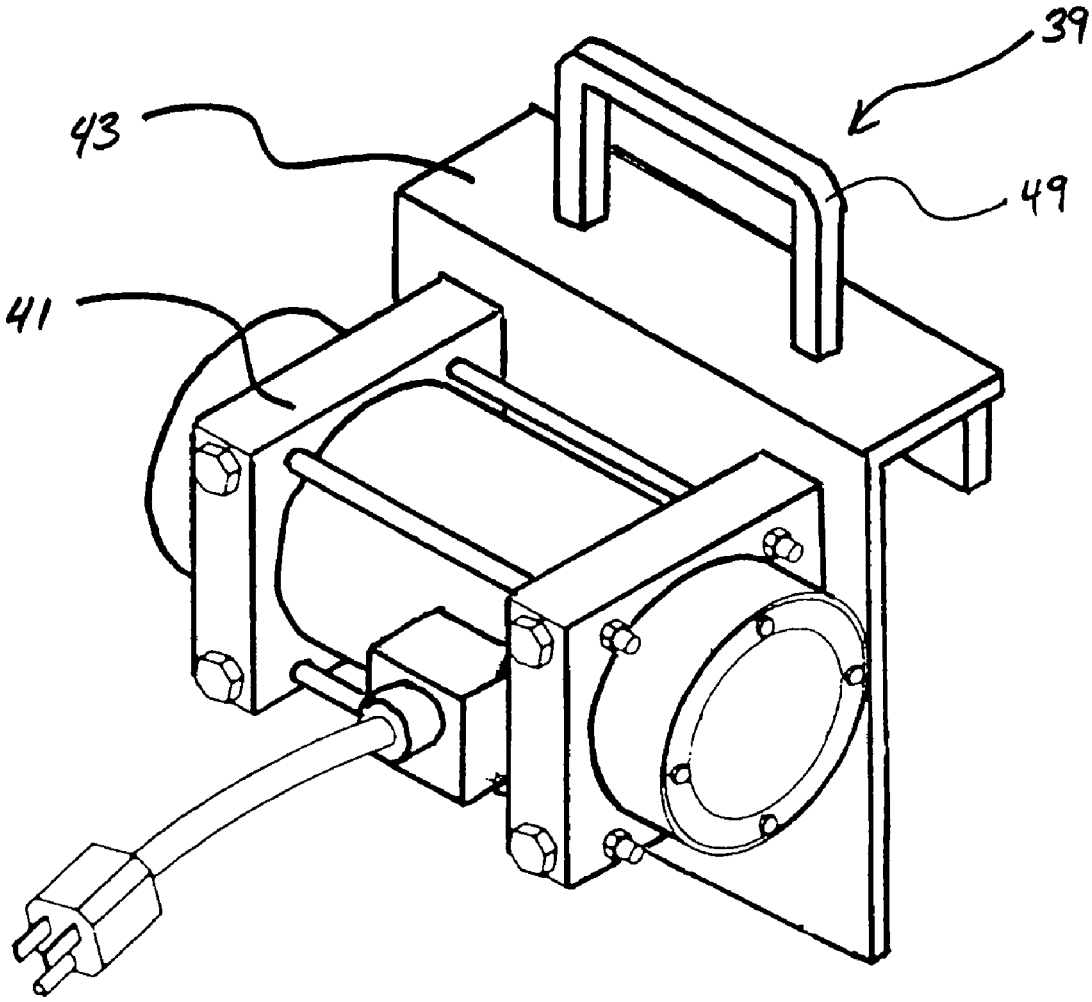
FIG. 18 is a perspective view of a vibrator operably coupled with a vibrator bracket portion of a vibrator bracket according to the present invention.

The vibrator system 41 and vibrator bracket 39 according to an embodiment is further depicted in FIGS. 16-18. The vibrator bracket 39 can comprise a vibrator bracket portion 43 for operably coupling with a vibrator system 41 and a form bracket portion 45 for operably coupling with the form 10. A vibrator system 41 operably coupled to the vibrator bracket portion 43 is depicted in FIG. 18. Referring to FIG. 16, the vibrator bracket portion 43 can comprise a handle 49 and can be operably engaged with or coupled with the form bracket portion 45. For example, a lip portion 51 included on the vibrator bracket portion 43 can operably engage a body portion 53 of the form bracket portion to retain the vibrator bracket portion 43. The form bracket portion 45 can also include a vibrator binder clamp 47 for securing the vibrator system 41 and vibrator bracket portion 43 with respect to the form 10 and form bracket portion 45 for effectively vibrating the form 10 and the contents thereof. The vibrator bracket portion 43 securingly coupled with the form bracket portion 45 is depicted in FIG. 17.

Referring to FIGS. 3 and 5-6, the inner shell 18 generally comprises a wall 36 having an outer surface 38 and a generally opposed inner surface 40. The inner shell 18 also comprises a generally planar bottom or base 42 operably coupled to or integrally formed with the inner shell wall 36. The inner shell 18 also comprises an upper edge or margin 44 that is generally opposed the inner shell base 42.

When the inner shell 18 of the vault form portion 12 is placed into the outer shell 16 of the vault form portion 12, the top margins 28, 44 of the outer and inner shells 16, 18 can be generally flush. In other embodiments, when the inner shell 18 of the vault form portion 12 is placed into the outer shell 16 of the vault form portion 12, the top margin 28 of the outer shell 16 can extend above or extend below the top margin 44 of the inner shell 18. The height of the outer and inner shells 16, 18 can be the same or similar or can vary from one another.

When the inner shell 18 of the vault form portion 12 is placed into the outer shell 16 of the vault form portion 12, the vault casting space 17 is defined between the inner surface 24 of the outer shell wall 20 and the outer surface 38 of the inner shell wall 18. While the inner shell 18 generally comprises a smaller diameter than the outer shell 16, the diameters of the outer and inner shells 16, 18 can be specifically selected such that the vault casting space 17 can be thicker or thinner that that depicted in the figures. For example, to cast a thinner vault casting, the diameter of the inner shell 18 can be increased and/or the diameter of the outer shell 16 can be decreased. The size and shape of the vault casting space 17 will then substantially correspond to the size and shape of the vault casting.

Referring to FIGS. 1 and 3-7, the lid form portion 14 generally comprises a shell or wall 46 and a generally planar bottom or base 48 operably coupled to or integrally formed with the wall 46. The lid form wall 46 generally comprises an outer surface 50 and a generally opposed inner surface 52. The lid form wall 46 also comprises an upper edge or margin 54 that is generally opposed the base 48 of the lid form portion 14.

Referring to FIG. 1, a plurality of lifting bored weldaments or eyelets 56 can be operably coupled to or integrally formed with the outer or inner surfaces 50, 52 of the lid form wall 46. The lifting eyelets 56 can be used to place the lid form portion 14 onto the vault form portion 12 or remove the lid form portion 14 from the vault form portion 12.

Figure 4:
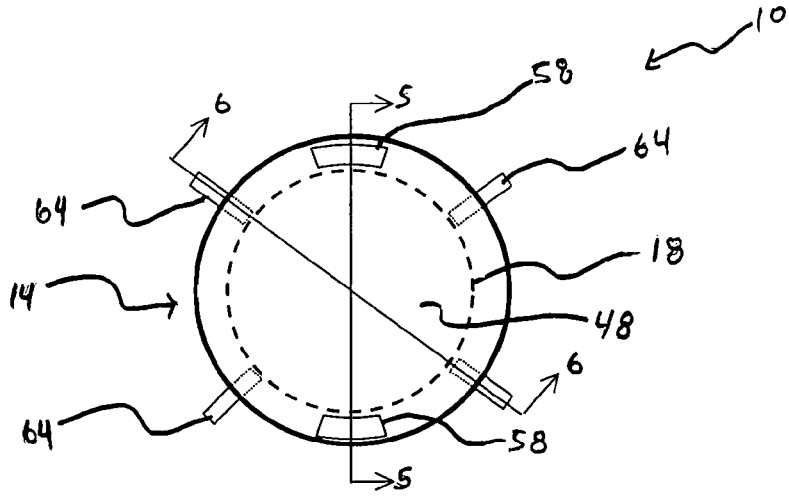
FIG. 4 is a top plan view of a septic tank casting form according to a first embodiment of the present invention, depicting a portion of the spacers in phantom lines

Referring to FIGS. 4-6, the lid form portion base 48 can comprise a plurality of apertures or ports 58 to enable concrete to be poured through the ports 58 and into the vault casting space 17 in the vault form portion 12. The ports 58 can be any of a number of shapes, including but not limited to circular, oval, or any regular or irregular polygonal shapes. The lid form portion base 48 can include any number of ports from zero and up.

Figure 7:
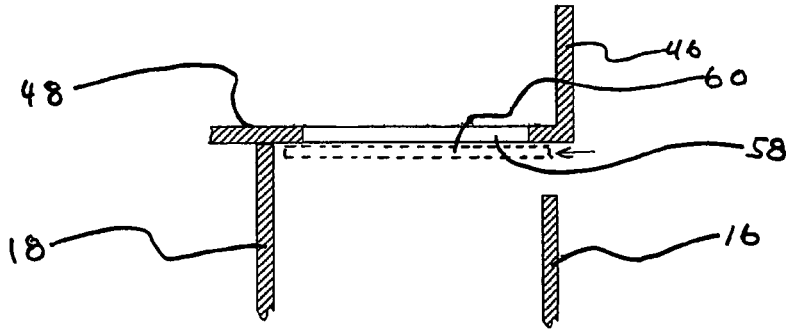
FIG. 7 is a fragmentary view of a septic tank casting form according to a first embodiment of the present invention, depicting the pouring port cover in phantom lines.

Referring to FIG. 7, the lid form portion base 48 can also include a cap or cover 60 that can be used to cover the ports 58 once the vault form portion 12 has been filled and it is desired to cast the cast lid in the lid form portion 14. The cover 60 can be any number of materials that those of skill in the art would use, including plywood, sheet metal, plastic, other polymers or any material that can effectively inhibit material poured into the lid form portion 14 from getting through the port and into the vault casting space 17. The cover 60 can be slid into a groove on The inner shell wall 36, either above or below lid form 18, to cover the port 60. Alternatively, the cover can be placed over the port.

Referring to FIG. 1, the lid form portion 14 can also include one or more manhole or inspection hole forms 62. The manhole or inspection hole forms 62 can be used such that a manhole or an inspection hole can be formed in the lid casting by creating areas in which the poured concrete will not flow because the flow is obstructed by the form 62.

The outer and inner shells 16, 18 of the vault form portion 12, the lid form portion 14, and the various subcomponents thereof can be constructed of sheet and/or plate steel, although those of skill in the art will recognize that other materials can be used for these components without departing from the scope and spirit of the present invention.

Referring FIGS. 1-2, 4, and 6, a plurality of spacers 64 can be positioned between the upper edges 28, 44 of the vault form portion 12 and the base 48 of lid form portion 14 to create a gap defined between the vault and lid form portions 12, 14. When the lid form portion 14 is operably coupled to the inner shell 18 of the vault form portion 12, the spacers 64 can also create a gap between the bases 26, 42 of the outer and inner shells 16, 18 of the vault form portion 12. This gap can effectively create a portion of the vault casting space 17 that will eventually create the base of a cast vault portion. The gap can also enable visual monitoring of the pouring process while filling the vault casting space 17. The gap can also enable access the vault casting space 17 to effectively level the casting material.

The spacers 64 can also be used to operably couple the lid closure latches 34. As depicted in FIG. 1, the lid closure latches 34 are operably coupled to spacers 64 that are operably attached to the lid form portion 14.

Figure 8:
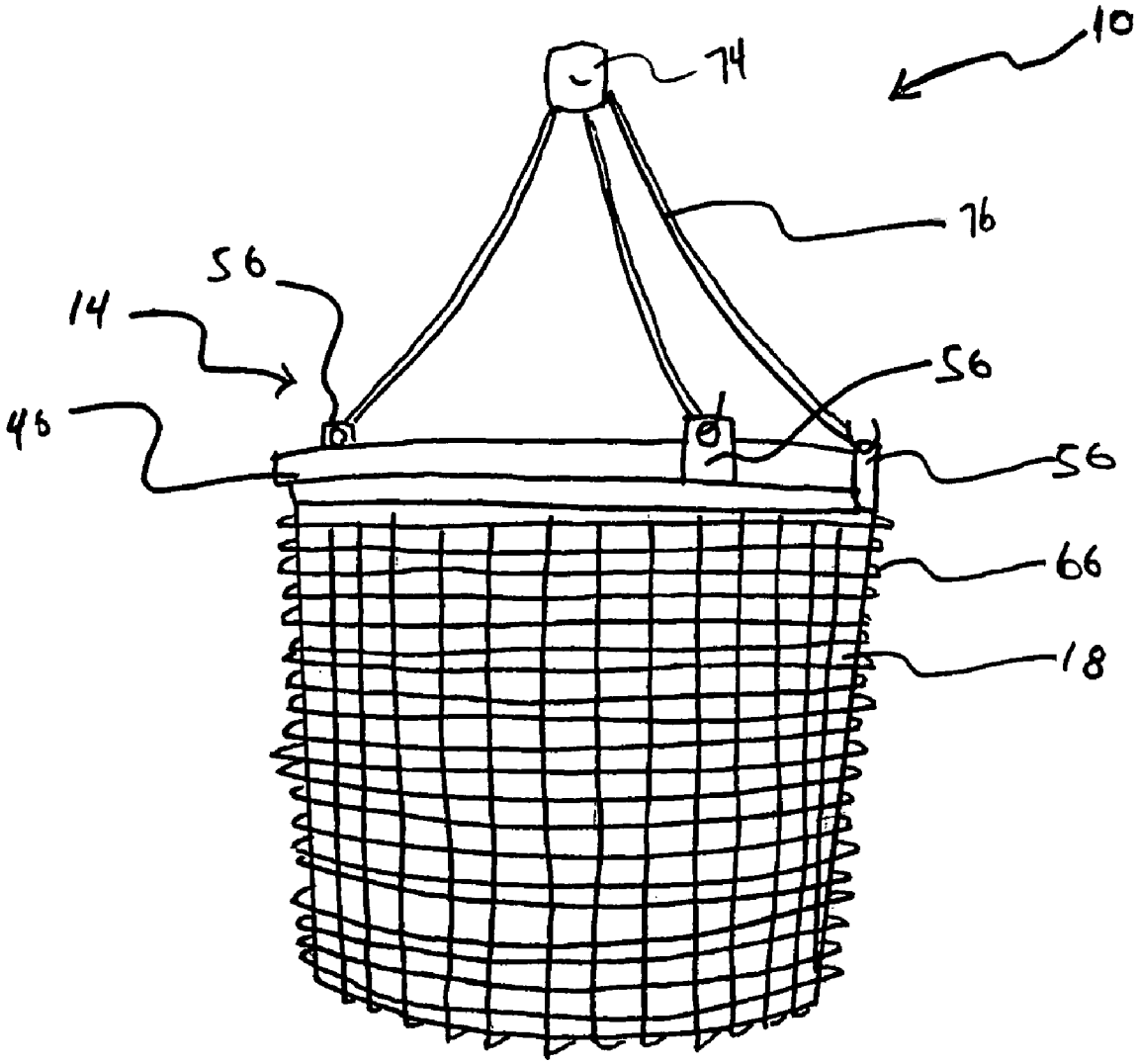
FIG. 8 is a perspective view of a septic tank casting form according to a first embodiment of the present invention, depicting a reinforcing cage operably coupled to an inner shell of the vault portion.
Figure 9:
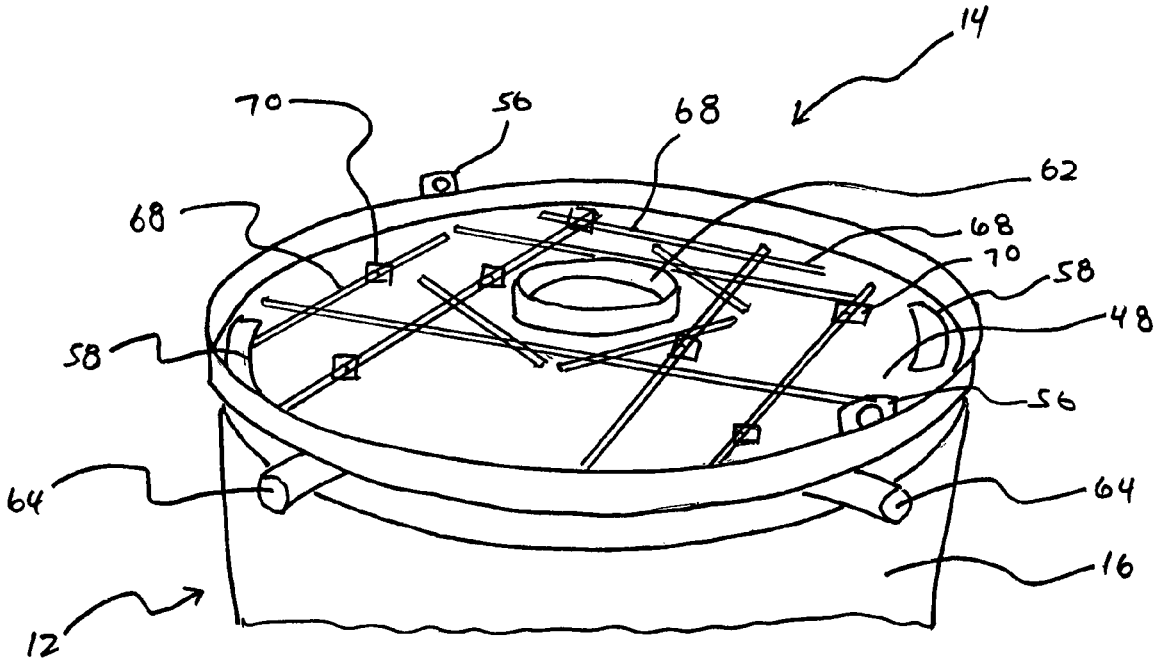
FIG. 9 is a perspective view of a septic tank casting form according to a first embodiment of the present invention, depicting reinforcing bar disposed in the lid form portion.

Referring to FIGS. 8 and 9, the form 10 according to the various embodiments also can comprise casting structures 16 including a reinforcing cage 66 constructed of wire or reinforcing bars, a plurality of steel or other reinforcing bars ("rebar") 68 having rebar clips 70, or various combinations thereof. In addition, the casting structure 16 can include one or more lifting hooks 72 that are operably formed into the lid portion and/or vault portion castings. The lifting hooks 72 can be operably coupled to the reinforcing cage 66 and/or rebar 68 to enable ease of lifting the casting with a crane or other lifting mechanism. In addition, by operably coupling the lifting hooks 72 to the reinforcing cage 66 and/or rebar 68, damage to the castings can be inhibited. The reinforcing cage 66 and rebar 68 can provide additional structural strength to the vault and lid castings once the casting have been cured.

To use the septic tank casting form 10 according the various embodiments to cast a septic tank of casting material, such as concrete or cement, the outer shell 16 of the vault form 12 is placed on level ground. The inner surface 24 of the outer shell wall 20 and the base 26 can be oiled or provided with a release agent to enable ease of removal of a casting from the shells 16, 18 once casting and curing are complete. The reinforcing cage 66 can then be operably coupled to the outer surface 38 of the inner vault shell 18 and rebar can be operably coupled to the reinforcing cage 66. In addition, rebar 68 can be placed into the lid form portion 14 and held into place using rebar clips or supports 70.

Referring to FIGS. 4-6, in various embodiments the inner shell 18 of the vault form portion 12 and the spacers 64 are operably coupled to the lid form portion 14. The lid form portion 14 and inner shell 18 of the vault form portion 12 can be placed in the outer shell 16 until the spacers 64 are operably supported by the upper edge 28 of the outer shell 16. The lid closure latches 34 can be engaged such that the lid form portion 14 and inner shell 18 are operably secured with respect to the outer shell 16 of the vault form portion 12. The concrete can then be poured into the vault casting space 17 defined by the outer and inner shells 16, 18 of the vault form portion 12. The concrete is poured through the apertures or ports 58 into the vault casting space 17. The lid closure latches 34 can restrain and inhibit or prevent any upward movement of the lid form 14 when casting material is disposed into the vault casting space 17. Such movement can result from the upward forces generated on the lid form 14 and inner shell, if attached to the lid form 14, as the casting material is disposed into the vault casting space 17. Once concrete has been filled into the vault form portion 12, the vault form portion 12 can be vibrated to assure proper filling and packing of the vault casting.

When the vault form portion 17 is filled and leveled, each port 58 can be blocked off with a cover 60, as depicted in phantom lines in FIG. 7. As discussed, the cover 60 can comprise a flat and substantially rigid material such as plywood or sheet metal, and can comprise and dimensions such that it can cover the portion and inhibit further casting material from falling or flowing from the lid form portion 14 through the port 58.

Once concrete has been filled into the a lid casting space 19 defined in the lid form portion 14, lifting hooks 72 can be selectively placed into the concrete in the lid form portion 14. The entire septic tank form 10 can be vibrated with the vibrator system 41 operably coupled to the vibrator bracket 39 to assure removal of air bubbles from the casting material and proper filling and packing of the vault and lid form portions 12, 14. The concrete can then be cured to become solid and rigid concrete.

Figure 10:
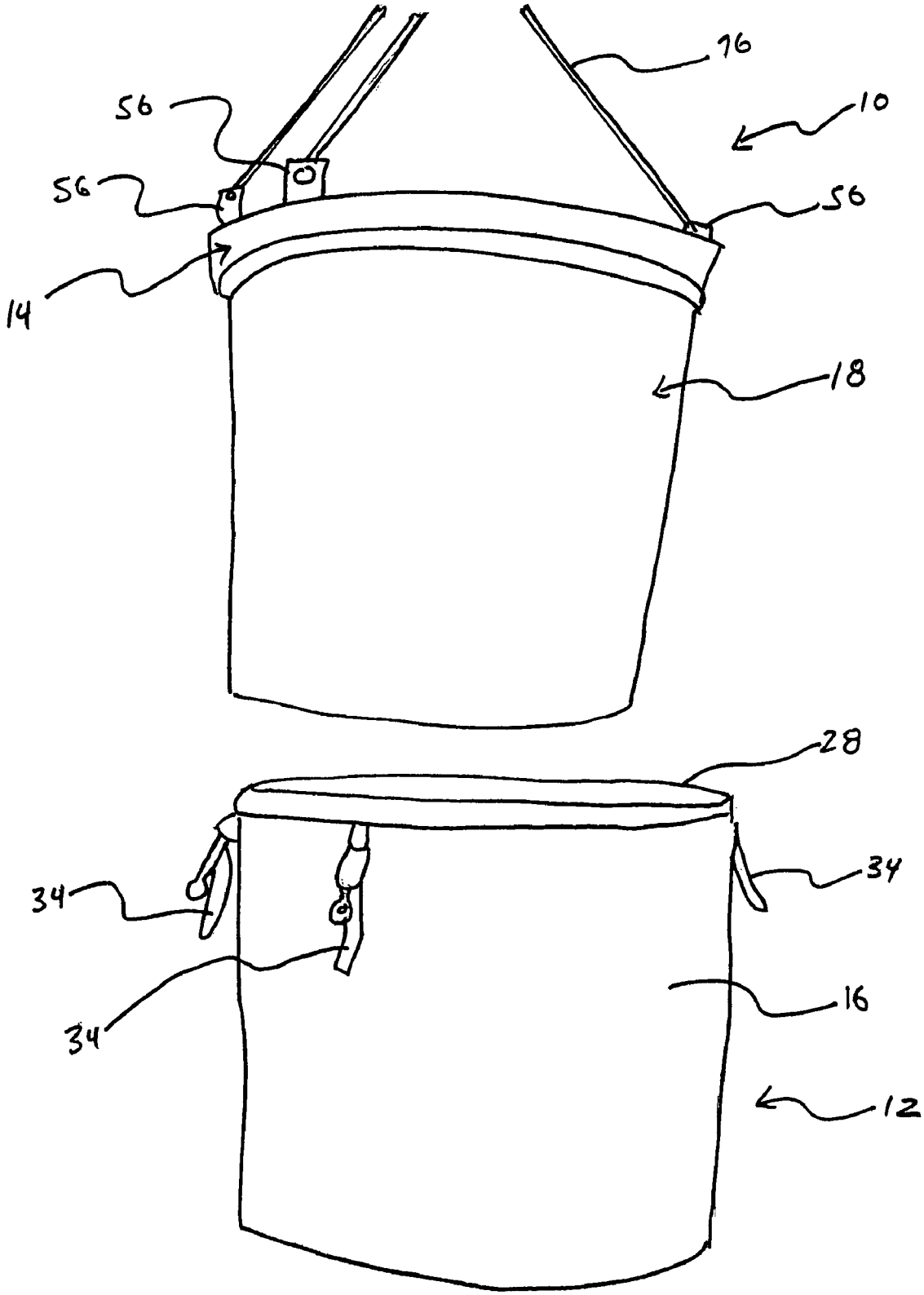
FIG. 10 is a perspective view of a septic tank casting form according to a first embodiment of the present invention, depicting the lid form portion and inner shell being removed from the outer shell of the vault form portion.

Referring to FIG. 10, after the concrete has sufficiently cured, the lid closure latches 34 can be disengaged such that the lid form portion 14 and inner shell 18 are no longer operably secured with respect to the outer shell 16 of the vault form portion 12. The lid form portion 14 operably coupled to the inner shell 18 of the vault form portion 12 can then be lifted out of the outer shell 18 using the eyelets 56 included on the wall 46 of the lid form portion 14. The lid form portion 14 can be lifted out using any sufficient lifting mechanism 74, for example, an overhead crane having lifting cables 76 attached thereto.

The outer shell 16 of the vault form portion 12 can then be released by first releasing the binder clamp 32. Release of the binder clamp mechanism 32 can enable ease of release of the vault casting 80 from the outer shell 16. In addition, a pneumatic system can be used to air release the vault casting 80 from the vault form portion 12.

Figure 11:
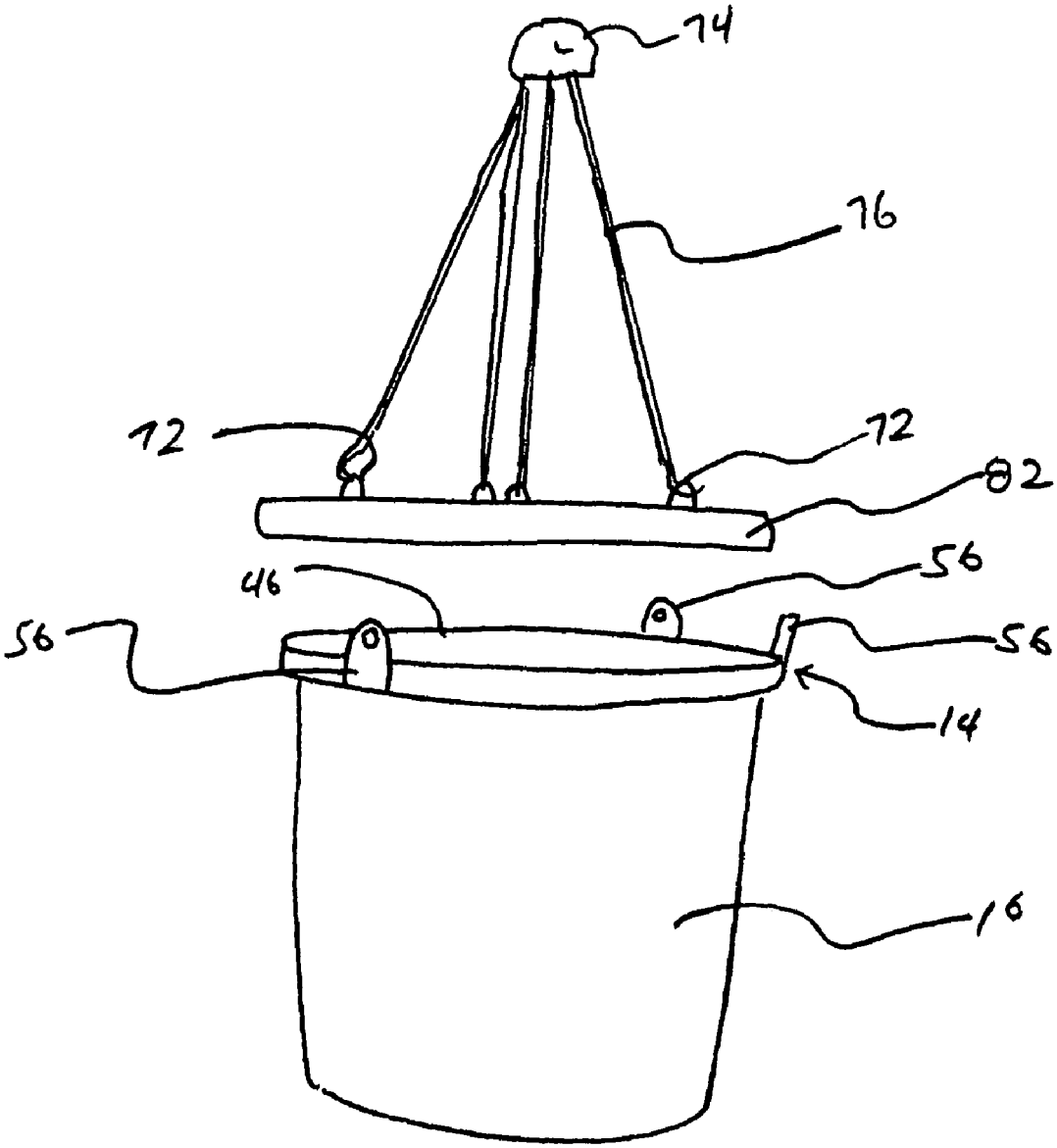
FIG. 11 is a perspective view of a septic tank casting form according to a first embodiment of the present invention, depicting the lid casting being removed from the lid form portion.
Figure 12:
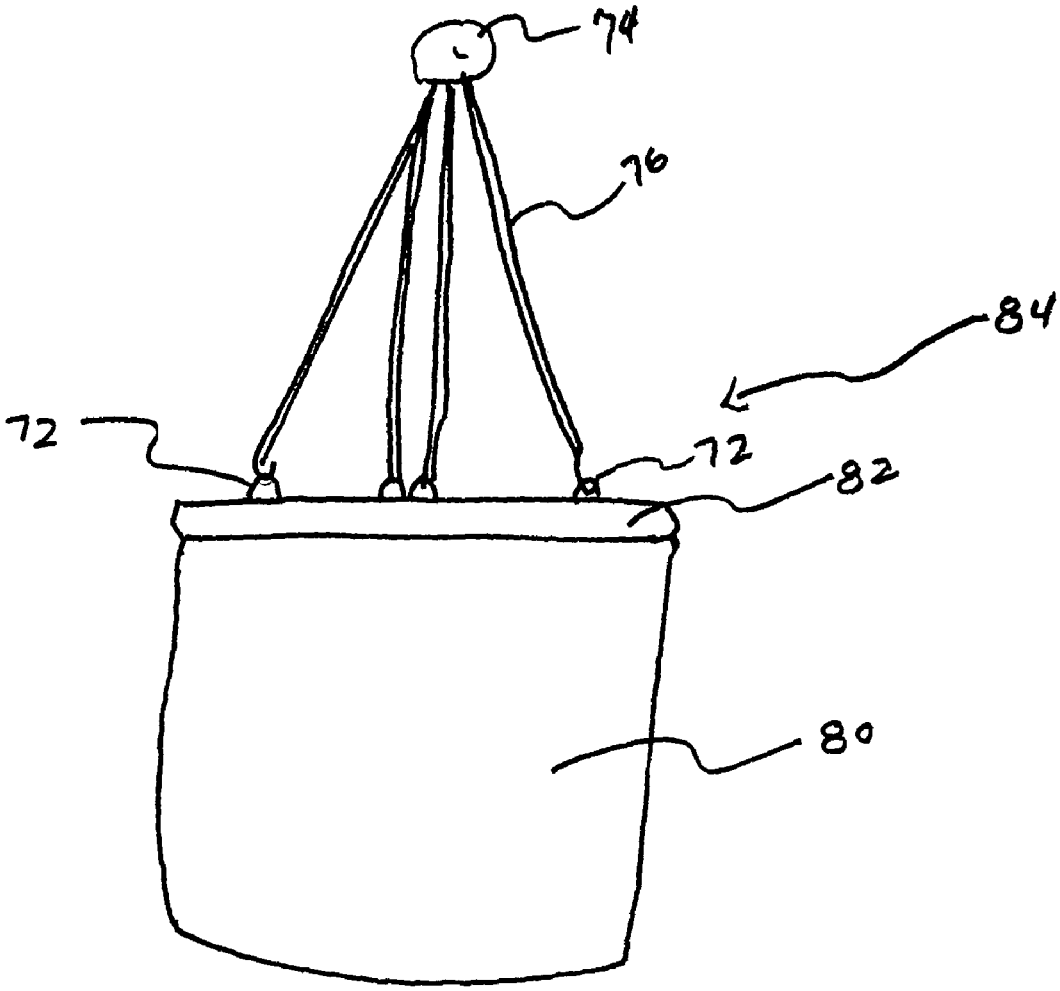
FIG. 12 is a perspective view of a septic tank casting form according to a first embodiment of the present invention, depicting the lid casting being placed on the vault casting to form the septic tank casting.

Referring to FIGS. 11 and 12, once the vault casting 80 has been removed from the outer shell 16, the lid casting 82 can be removed from the lid form portion 14 using the lifting hooks 72 and then placed onto the vault casting 80. The vault and lid castings 80, 82 can include corresponding step portions to enable ease of seating the cast lid 80 onto the cast vault 82.

Referring to FIGS. 13-15, a septic tank casting mold 110 according to a second embodiment is depicted. In this embodiment, the mold 110 is not cylindrical, but rather comprises a polyhedron shape, specifically a polyhedron shape comprising a rectangular cross-section.

The septic tank form 110 generally comprises a vault form portion 112 and a lid form portion 114, each of the portions 112, 114 comprise a generally rectangular cross section. Referring FIG. 13, a plurality of spacers 164 can be positioned between the upper edges 128, 144 of the vault form portion 112 and the base 148 of lid form portion 114 to create a gap defined between the vault and lid form portions 112, 114. When the lid form portion 114 is operably coupled to the inner shell 118 of the vault form portion 112, the spacers 164 can also create a gap between the bases 126, 142 of the outer and inner shells 116, 118 of the vault form portion 112. This gap can effectively create a portion of the vault casting space 117 that will eventually create the base of a cast vault portion. The gap can also enable visual monitoring of the pouring process while filling the vault casting space 117. The gap can also enable access the vault casting space 117 to effectively level the casting material.

Referring to FIGS. 13 and 15, the lid form portion base 148 can comprise a plurality of apertures or ports 158 to enable concrete to be poured through the ports 158 and into the vault casting space 117 in the vault form portion 112. The ports 158 can be any of a number of shapes, including but not limited to circular, oval, or any regular or irregular polygonal shapes. The lid form portion base 148 can include any number of ports from zero and up.

Referring to FIG. 15, the lid form portion 114 can also include one or more manhole or inspection hole forms 162. The manhole or inspection hole forms 162 can be used such that a manhole or an inspection hole can be formed in the lid casting by creating areas in which the poured concrete will not flow because the flow is obstructed by the form 162.

The outer shell 116 can also comprise a vibrator bracket 139 upon which a vibrator system 141 can be operable coupled. When coupled with the vibrator bracket 139, the vibrator system 141 can vibrate both the vault and lid form portions 112, 114.

Although the present invention has been described with reference to particular embodiments, one skilled in the art will recognize that changes may be made in form and detail without departing from the spirit and the scope of the invention. For example, while the present invention has been described with respect to septic tank casting, the various aspects described herein can be used with any casting. In addition, while the present invention has been described with respect to casting with concrete, the various aspects described herein can be used with any of a number of casting materials that those of skill in the art would recognize. Therefore, the illustrated embodiments should be considered in all respects as illustrative and not restrictive.

What is claimed is:

1. A casting mold for casting a concrete vault portion having a lower base and a wall extending upwardly from the lower base and a lid portion, the casting mold comprising: a first form having a first wall extending upwardly from a first base and a second wall extending upwardly from a second base, the first and second walls and first and second bases defining a first casting space configured to form the vault portion, the first casting space including a base casting space for forming a base portion of the vault defined between the first base and the second base; a second form comprising a base and a wall extending from the base to define a second casting space configured to form the lid portion, the second form being selectively stackable on the first form during casting such that casting material can be disposed into the first and second casting spaces, including into the base casting space, when the second form is selectively stacked on the first form; a port defined through the second form operably defining access into the first casting space located below the port such that the casting material can be disposed into the first casting space through the port; and a port cover configured to selectively cover the port between the first form and the second form such that the casting material can be effectively filled into the second casting space instead of being disposed into the first casting space through the port when the port cover selectively covers the port, and whereby the casting mold is not disassembled during casting.

2. The casting mold of claim 1, wherein the port is defined on the second form, such that the casting material is disposed into the first casting space through the port defined on the second form.

3. The casting mold of claim 1, further comprising a bracket operably coupled to the casting mold and configured to selectively support a vibrator system.

4. The casting mold of claim 1, further comprising a latch mechanism for selectively coupling the second form with the first form.

5. The casting mold of claim 1, further comprising a clamp operably coupled to the first form for selectively releasing the first form from a casting.

6. The casting mold of claim 1, wherein the first and second forms are cylindrical.

7. The casting mold of claim 1, wherein the first and second forms each comprise rectangular cross sections.

8. The casting mold of claim 1, wherein the casting material is concrete.

9. A septic tank form for forming a concrete septic tank comprising a vault casting and a lid casting without disassembling the septic tank form during casting, the septic tank form comprising: a vault form portion having a vault casting space defined therein configured for forming a vault casting, the vault casting space defined by an inner form having a base and a wall extending upwardly from the base and an outer form having a base and a wall extending upwardly from the base, the vault casting space including a base casting space for forming a base portion of the vault casting, the base casting space defined between the base of the inner form and the base of the outer form; and a lid form portion selectively stackable on the vault form portion during casting, the lid form portion having lid casting space defined therein configured for forming a lid casting; a port defined on the lid form portion configured to provide access into the vault casting space below the port, including into the base casting space, through the lid form portion; and a port cover configured to selectively cover the port between the first form and the second form such that the casting material can be effectively filled into the lid casting space instead of being disposed in to the base casting space through the port when the port cover selectively covers the port.

10. The septic tank form of claim 9, further comprising a bracket operably coupled to the vault form configured to selectively support a vibrator system.

11. The septic tank form of claim 9, further comprising a latch mechanism for selectively coupling the lid form with the vault form.

12. The septic tank form of claim 9, further comprising a binder clamp operably coupled to the vault form for selectively releasing the vault form from a vault casting.

13. The casting mold of claim 1, further comprising at least one spacer positioned between the base of the second form and an upper surface of at least one of the first wall and second wall of the first form to define a gap between the second form and the first form.

14. The septic tank form of claim 9, further comprising at least one spacer positioned between a bottom surface of the lid form portion and an upper surface of the wall of at least one of the inner form and outer form of the vault form portion to define a gap between the lid form portion and the vault form portion.

* * * * *

UNITED STATES PATENT AND TRADEMARK OFFICE

CERTIFICATE OF CORRECTION

PATENT NO. : 7,731,149 B2
APPLICATION NO. : 11/209207
DATED : June 8, 2010
INVENTOR(S) : William M. Del Zotto It is certified that error appears in the above-identified patent and that said Letters Patent is hereby corrected as shown below:

Column 2, line 66:
"according the various embodiments can be generally cylin-" should be -- according to the various embodiments can be generally cylin- --

Column 3, line 23:
"coupled to the outer surface 22 of the out shell 15 and can" should be -- coupled to the outer surface 22 of the outer shell 15 and can --

Column 4, line 43:
"that the vault casting space 17 can be thicker or thinner that" should be -- that the vault casting space 17 can be thicker or thinner than"

Column 5, line 14:
"a groove on The inner shell wall 36, either above or below lid" should be -- a groove on the inner shell wall 36, either above or below lid --

Column 5, line 29:
"Referring FIGS. 1-2, 4 and 6, a plurality of spacers 64 can" should be -- Referring to FIGS. 1-2, 4 and 6, a plurality of spacers 64 can --

Column 7, line 10:
"Referring FIG. 13, a plurality of spacers 164 can be posi-" should be -- Referring to FIG. 13, a plurality of spacers 164 can be posi- --

Signed and Sealed this
Sixteenth Day of October, 2012

David J. Kappos

David J. Kappos
*Director of the United States Patent and Trademark Office*